US012601350B2

(12) United States Patent
Izumi et al.

(10) Patent No.: US 12,601,350 B2
(45) Date of Patent: Apr. 14, 2026

(54) COMPRESSOR AND REFRIGERATION CYCLE APPARATUS

(71) Applicant: Mitsubishi Electric Corporation, Tokyo (JP)

(72) Inventors: Akikazu Izumi, Tokyo (JP); Naohisa Gomae, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 18/863,383

(22) PCT Filed: Aug. 4, 2022

(86) PCT No.: PCT/JP2022/029873
§ 371 (c)(1),
(2) Date: Nov. 6, 2024

(87) PCT Pub. No.: WO2024/029014
PCT Pub. Date: Feb. 8, 2024

(65) Prior Publication Data
US 2025/0314253 A1 Oct. 9, 2025

(51) Int. Cl.
*F04C 23/00* (2006.01)
*F04C 18/356* (2006.01)

(52) U.S. Cl.
CPC ..... *F04C 23/008* (2013.01); *F04C 18/356* (2013.01)

(58) Field of Classification Search
CPC ..... F04C 23/008; F04C 18/356
See application file for complete search history.

(56) References Cited

U.S. PATENT DOCUMENTS 4,342,547 A 8/1982 Yamada et al.
5,242,280 A * 9/1993 Fujio ..... F04C 23/008 418/268

(Continued)

FOREIGN PATENT DOCUMENTS

CA 2099989 C 3/2000
EP 1972786 A2 * 9/2008 ..... F04C 23/008

(Continued)

OTHER PUBLICATIONS

International Search Report of the International Searching Authority mailed Oct. 25, 2022 for the corresponding International Application No. PCT/JP2022/029873 (and English translation).

(Continued)

*Primary Examiner* — Jesse S Bogue
(74) *Attorney, Agent, or Firm* — Posz Law Group, PLC

(57) ABSTRACT

A compressor includes: a hermetically sealed container; an electric motor; a low-stage compression mechanism unit; a high-stage compression mechanism unit; and an intermediate partition plate. The high-stage compression mechanism unit includes a high-stage cylinder block, a high-stage rolling piston, a high-stage vane configured to partition, along with the high-stage rolling piston, an internal space of the high-stage cylinder block into a high-stage suction chamber and a high-stage compression chamber, and a high-stage refrigerant supply passage through which compressed refrigerant is discharged, the high-stage refrigerant supply being surrounded by a high-stage bearing and a high-stage discharge muffler. A high-stage back pressure chamber is separate from an internal space of the hermetically sealed container, and communicates with the high-stage refrigerant supply passage, the high-stage back pressure chamber being surrounded by the high-stage cylinder (Continued)

block, the high-stage bearing, the intermediate partition plate, and the high-stage vane.

11 Claims, 9 Drawing Sheets

(56) References Cited

U.S. PATENT DOCUMENTS

| | | | | |
|---|---|---|---|---|
| 5,322,424 | A * | 6/1994 | Fujio | F04C 18/3564 418/60 |
| 8,104,307 | B2 * | 1/2012 | Hasegawa | F04C 29/025 62/468 |
| 10,072,661 | B2 * | 9/2018 | Ozu | F04C 15/0092 |
| 2004/0071576 | A1 * | 4/2004 | Matsumoto | F04C 23/008 418/249 |
| 2007/0071628 | A1 * | 3/2007 | Newland | F01C 21/0845 418/125 |
| 2007/0140881 | A1 | 6/2007 | Matsumoto et al. | |
| 2008/0199338 | A1 | 8/2008 | Matsumoto et al. | |
| 2008/0286137 | A1 | 11/2008 | Matsumoto et al. | |
| 2008/0292485 | A1 | 11/2008 | Matsumoto et al. | |
| 2017/0138360 | A1 * | 5/2017 | Gao | F04C 29/12 |

FOREIGN PATENT DOCUMENTS

| | | | | |
|---|---|---|---|---|
| JP | S52-018409 | U1 | 2/1977 | |
| JP | S55-134785 | A | 10/1980 | |
| JP | H05-133367 | A | 5/1993 | |
| JP | 2006-161713 | A | 6/2006 | |
| JP | 2007-162658 | A | 6/2007 | |
| JP | 2007-162660 | A | 6/2007 | |
| JP | 4258132 | B2 * | 4/2009 | F04C 23/008 |
| JP | 2021-193290 | A | 12/2021 | |
| WO | 2012/090345 | A1 | 7/2012 | |

OTHER PUBLICATIONS

Office Action dated Aug. 5, 2025 issued in corresponding JP patent application No. 2024-538597 (and English machine translation).

* cited by examiner

E-E

COMPRESSOR AND REFRIGERATION CYCLE APPARATUS

CROSS REFERENCE TO RELATED APPLICATION

This application is a U.S. national stage application of PCT/JP2022/029873 filed on Aug. 4, 2022, the contents of which are incorporated herein by reference.

TECHNICAL FIELD

The present disclosure relates to a compressor and a refrigeration cycle apparatus.

BACKGROUND ART

A two-stage compressor has been widely known as having a low-stage compression mechanism unit configured to compress low-pressure refrigerant to intermediate pressure, and a high-stage compression mechanism unit configured to compress the intermediate-pressure refrigerant to high pressure.

In addition, a compressor has been known as employing a vane mechanism for a compression mechanism unit since the vane mechanism has high compression efficiency and is low-cost. The vane mechanism will be described later.

For example, Patent Literature 1 discloses a two-stage compressor having a low-stage compression mechanism unit and a high-stage compression mechanism unit, for which a vane mechanism is employed.

In the two-stage compressor described in Patent Literature 1, the low-stage compression mechanism unit supplies intermediate-pressure refrigerant to the high-stage compression mechanism unit, and the high-stage compression mechanism unit discharges high-pressure refrigerant to the outside of a hermetically sealed container via its internal space. The high-pressure refrigerant released to the internal space of the hermetically sealed container then pressurizes lubricant oil reserved in a bottom portion of the hermetically sealed container, so that the lubricant oil is brought into a high-pressure state.

Each of the compression mechanism units includes a cylinder with a cylindrical shape, a rolling piston with a cylindrical shape and located in an internal space of the cylinder, and a vane located in the cylinder such that the vane is slidable in a radial direction of the cylinder. In the cylinder, a vane back pressure chamber is formed, which communicates with the lubricant oil through a connecting flow passage.

The vane is pressed against the rolling piston by a spring provided to the vane back pressure chamber. The vane along with the rolling piston divide the internal space of the cylinder into two spaces. By changing the volumes of these two spaces, the low-stage compression mechanism unit compresses the low-pressure refrigerant to intermediate pressure, while the high-stage compression mechanism unit compresses the intermediate-pressure refrigerant to high pressure. With this configuration, in the two-stage compressor described in Patent Literature 1, the internal space of the cylinder provided in the high-stage compression mechanism unit is filled with the high-pressure refrigerant, while the vane back pressure chamber provided in the high-stage compression mechanism unit is filled with the high-pressure lubricant oil.

CITATION LIST

Patent Literature

Patent Literature 1: WO 2012/090345

SUMMARY OF INVENTION

Technical Problem

However, there is a case where the configuration, in which the vane back pressure chamber communicates with the lubricant oil through the connecting flow passage, is employed for a two-stage compressor in which a low-stage compression mechanism unit supplies intermediate-pressure refrigerant to a high-stage compression mechanism unit via an internal space of a hermetically sealed container. In this case, the intermediate-pressure refrigerant released to the internal space of the hermetically sealed container pressurizes the lubricant oil reserved in the bottom portion of the hermetically sealed container, so that the lubricant oil is brought into an intermediate-pressure state. With this configuration, the internal space of the cylinder provided in the high-stage compression mechanism unit is filled with the high-pressure refrigerant, while the vane back pressure chamber provided in the high-stage compression mechanism unit is filled with the intermediate-pressure lubricant oil. This causes a difference in the pressure state between the vane back pressure chamber and the internal space of the cylinder, which generates a force applied to the vane in a direction from the internal space of the cylinder toward the vane back pressure chamber. Consequently, the vane is likely to separate from the rolling piston. This results in a problem that poor contact between the vane and the rolling piston occurs.

The present disclosure has been made to solve the above problems, and it is an object of the present disclosure to provide a two-stage compressor that can prevent poor contact between a vane and a rolling piston.

Solution to Problem

A compressor according to one embodiment of the present disclosure includes: a hermetically sealed container; an electric motor; a low-stage compression mechanism unit driven by a crankshaft fitted into the electric motor and configured to compress low-pressure refrigerant to intermediate pressure; a high-stage compression mechanism unit driven by the crankshaft and configured to compress intermediate-pressure refrigerant discharged by the low-stage compression mechanism unit to high pressure; and an intermediate partition plate provided between the low-stage compression mechanism unit and the high-stage compression mechanism unit, the electric motor, the low-stage compression mechanism unit, the high-stage compression mechanism unit, and the intermediate partition plate being accommodated in an internal space of the hermetically sealed container, the high-stage compression mechanism unit including a high-stage cylinder block with a cylindrical shape, a high-stage rolling piston located in an internal space of the high-stage cylinder block, a high-stage vane located in the high-stage cylinder block such that the high-stage vane is slidable in a radial direction of the high-stage cylinder block, the high-stage vane being configured to partition, along with the high-stage rolling piston, the internal space of the high-stage cylinder block into a high-stage suction chamber into which refrigerant is sucked and a high-stage compression chamber in which refrigerant is compressed, and a high-stage refrigerant supply passage serving as a path through which refrigerant compressed in the high-stage compression chamber is discharged to a space external to the hermetically sealed container, the high-stage refrigerant supply passage being a space surrounded by a high-stage bearing and a high-stage discharge muffler, the high-stage bearing supporting the crankshaft and being adjacent to the high-stage cylinder block in an axial direction of the high-stage cylinder block, the high-stage discharge muffler being adjacent to the high-stage bearing in an axial direction of the high-stage cylinder block, the high-stage cylinder block including a high-stage back pressure chamber, the high-stage back pressure chamber being a space surrounded by an outer circumferential surface of the high-stage cylinder block, the high-stage bearing, the intermediate partition plate, and the high-stage vane, the high-stage back pressure chamber being a space separate from the internal space of the hermetically sealed container, and communicating with the high-stage refrigerant supply passage.

A refrigeration cycle apparatus according to another embodiment of the present disclosure includes a compressor including: a hermetically sealed container; an electric motor; a low-stage compression mechanism unit driven by a crankshaft fitted into the electric motor and configured to compress low-pressure refrigerant to intermediate pressure; a high-stage compression mechanism unit driven by the crankshaft and configured to compress intermediate-pressure refrigerant discharged by the low-stage compression mechanism unit to high pressure; and an intermediate partition plate provided between the low-stage compression mechanism unit and the high-stage compression mechanism unit, the electric motor, the low-stage compression mechanism unit, the high-stage compression mechanism unit, and the intermediate partition plate being accommodated in an internal space of the hermetically sealed container, the high-stage compression mechanism unit including a high-stage cylinder block with a cylindrical shape, a high-stage rolling piston located in an internal space of the high-stage cylinder block, a high-stage vane located in the high-stage cylinder block such that the high-stage vane is slidable in a radial direction of the high-stage cylinder block, the high-stage vane being configured to partition, along with the high-stage rolling piston, the internal space of the high-stage cylinder block into a high-stage suction chamber into which refrigerant is sucked and a high-stage compression chamber in which refrigerant is compressed, and a high-stage refrigerant supply passage serving as a path through which refrigerant compressed in the high-stage compression chamber is discharged to a space external to the hermetically sealed container, the high-stage refrigerant supply passage being a space surrounded by a high-stage bearing and a high-stage discharge muffler, the high-stage bearing supporting the crankshaft and being adjacent to the high-stage cylinder block in an axial direction of the high-stage cylinder block, the high-stage discharge muffler being adjacent to the high-stage bearing in an axial direction of the high-stage cylinder block, the high-stage cylinder block including a high-stage back pressure chamber, the high-stage back pressure chamber being a space surrounded by an outer circumferential surface of the high-stage cylinder block, the high-stage bearing, the intermediate partition plate, and the high-stage vane, the high-stage back pressure chamber being a space separate from the internal space of the hermetically sealed container, and communicating with the high-stage refrigerant supply passage, the refrigeration cycle apparatus further including: a condenser liquefying refrigerant discharged from the compressor; a pressure-reducing device configured to reduce a pressure of refrigerant delivered from the condenser; and an evaporator gasifying refrigerant delivered from the pressure-reducing device, the refrigerant cycle apparatus still further including a condenser liquefying fluid, a pressure-reducing device configured to reduce a pressure of compressed fluid, and an evaporator gasifying fluid.

Advantageous Effects of Invention

According to an embodiment of the present disclosure, it is possible to prevent poor contact between the vane and the rolling piston.

DESCRIPTION OF EMBODIMENTS

Embodiments of the present disclosure will be described below with reference to the accompanying drawings. Note that the drawings are schematically shown, and the mutual relationship between sizes and positions illustrated in individual drawings is not necessarily described accurately and may be appropriately changed. Moreover, in the following descriptions, the same constituent elements are denoted by the same reference signs, and their names and functions are also the same or similar. Therefore, detailed descriptions of the same constituent elements may be omitted.

Embodiment 1

Figure 1:
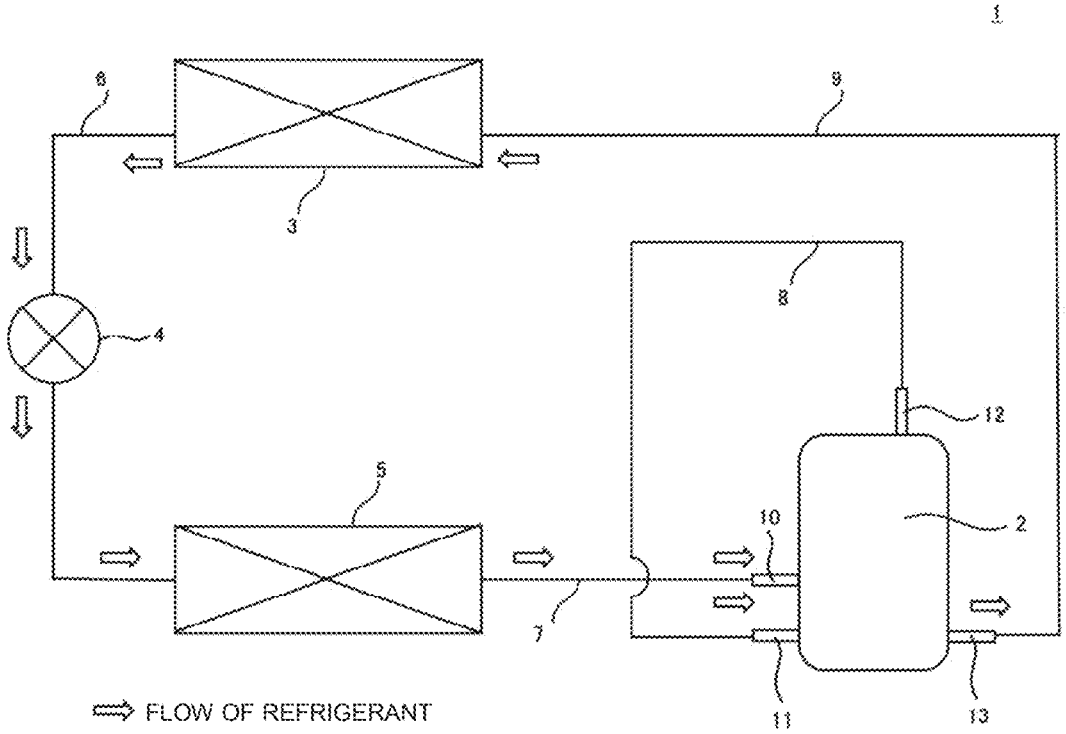
FIG. 1 illustrates a refrigeration cycle apparatus according to Embodiment 1.

With reference to FIG. 1, a refrigeration cycle apparatus 1 according to the present embodiment is described below. The refrigeration cycle apparatus 1 includes a compressor 2, a high-pressure side heat exchanger 3, a pressure-reducing device 4, a low-pressure side heat exchanger 5, a refrigerant pipe 6, and a controller (not illustrated).

The compressor 2, the high-pressure side heat exchanger 3, the pressure-reducing device 4, and the low-pressure side heat exchanger 5 are connected by the refrigerant pipe 6, forming a refrigeration cycle in which refrigerant circulates through the compressor 2, the high-pressure side heat exchanger 3, the pressure-reducing device 4, and the low-pressure side heat exchanger 5 in the order described.

The refrigerant pipe 6 includes a low-pressure refrigerant pipe 7 through which low-pressure refrigerant flows, an intermediate-pressure refrigerant pipe 8 through which intermediate-pressure refrigerant flows, and a high-pressure refrigerant pipe 9 through which high-pressure refrigerant flows. The low-pressure refrigerant pipe 7 connects the low-pressure side heat exchanger 5 and a refrigerant suction pipe 10. The intermediate-pressure refrigerant pipe 8 connects a refrigerant discharge pipe 12 and a refrigerant suction pipe 11. The high-pressure refrigerant pipe 9 connects a refrigerant discharge pipe 13 and the high-pressure side heat exchanger 3.

The compressor 2 compresses refrigerant sucked from the refrigerant suction pipe 10 to intermediate pressure, discharges the compressed refrigerant from the refrigerant discharge pipe 12, and sucks refrigerant from the refrigerant suction pipe 11 through the intermediate-pressure refrigerant pipe 8. The compressor 2 then compresses the refrigerant sucked from the refrigerant suction pipe 11 to high pressure, and discharges the compressed refrigerant from the refrigerant discharge pipe 13.

The high-pressure side heat exchanger 3 serves as a condenser and allows the refrigerant compressed by the compressor 2 to exchange heat with air, thus transferring heat of the compressed refrigerant to the air and hence liquefying the refrigerant.

The pressure-reducing device 4 expands the refrigerant having transferred heat to the air at the high-pressure side heat exchanger 3.

The low-pressure side heat exchanger 5 serves as an evaporator and allows the refrigerant expanded by the pressure-reducing device 4 to exchange heat with air, thus heating the expanded refrigerant and hence gasifying the refrigerant.

The controller controls a flow of refrigerant by controlling the refrigeration cycle apparatus 1 in its entirety in accordance with an instruction from an input device such as a remote control. For example, the controller controls the frequency of the compressor 2. The controller is made up of, for example, an analog circuit, a digital circuit, a central processing unit (CPU), and a memory, or is made up of a combination of two or more of these elements. The controller may be provided in the refrigeration cycle apparatus 1, or may be provided in a separate housing.

Operation of the refrigeration cycle apparatus 1 is described below. The arrows illustrated in FIG. 1 each show the direction of refrigerant flow.

As the compressor 2 is driven, refrigerant compressed by the compressor 2 is discharged from its refrigerant discharge pipe 13. The refrigerant discharged from the compressor 2 flows into the high-pressure side heat exchanger 3. Through the high-pressure side heat exchanger 3, the refrigerant flowing in the high-pressure side heat exchanger 3 exchanges heat with air, so that heat of the refrigerant is transferred to the air. The refrigerant delivered from the high-pressure side heat exchanger 3 to the pressure-reducing device 4 is expanded in the pressure-reducing device 4. The refrigerant expanded by the pressure-reducing device 4 flows into the low-pressure side heat exchanger 5. Through the low-pressure side heat exchanger 5, the refrigerant flowing in the low-pressure side heat exchanger 5 exchanges heat with air, so that the refrigerant is heated. The refrigerant delivered from the low-pressure side heat exchanger 5 flows into the compressor 2 and is then compressed. The compressed refrigerant is discharged from the compressor 2 again. This cycle is repeated.

Examples of the refrigerant include hydrofluorocarbon (HFC) refrigerants such as R32, R125, R134a, R407C, and R410A, hydrofluoroolefin (HFO) refrigerants such as R1123, R1132(E), R1132(Z), R1132a, R1141, R1234yf, R1234ze(E), and R1234ze(Z), and natural refrigerants such as R290 (propane), R600a (isobutane), R744 (carbon dioxide), and R717 (ammonia). At least one of these types of refrigerants is used.

With reference to FIGS. 2 to 5, the compressor 2 in the present embodiment is described below.

Figure 2:
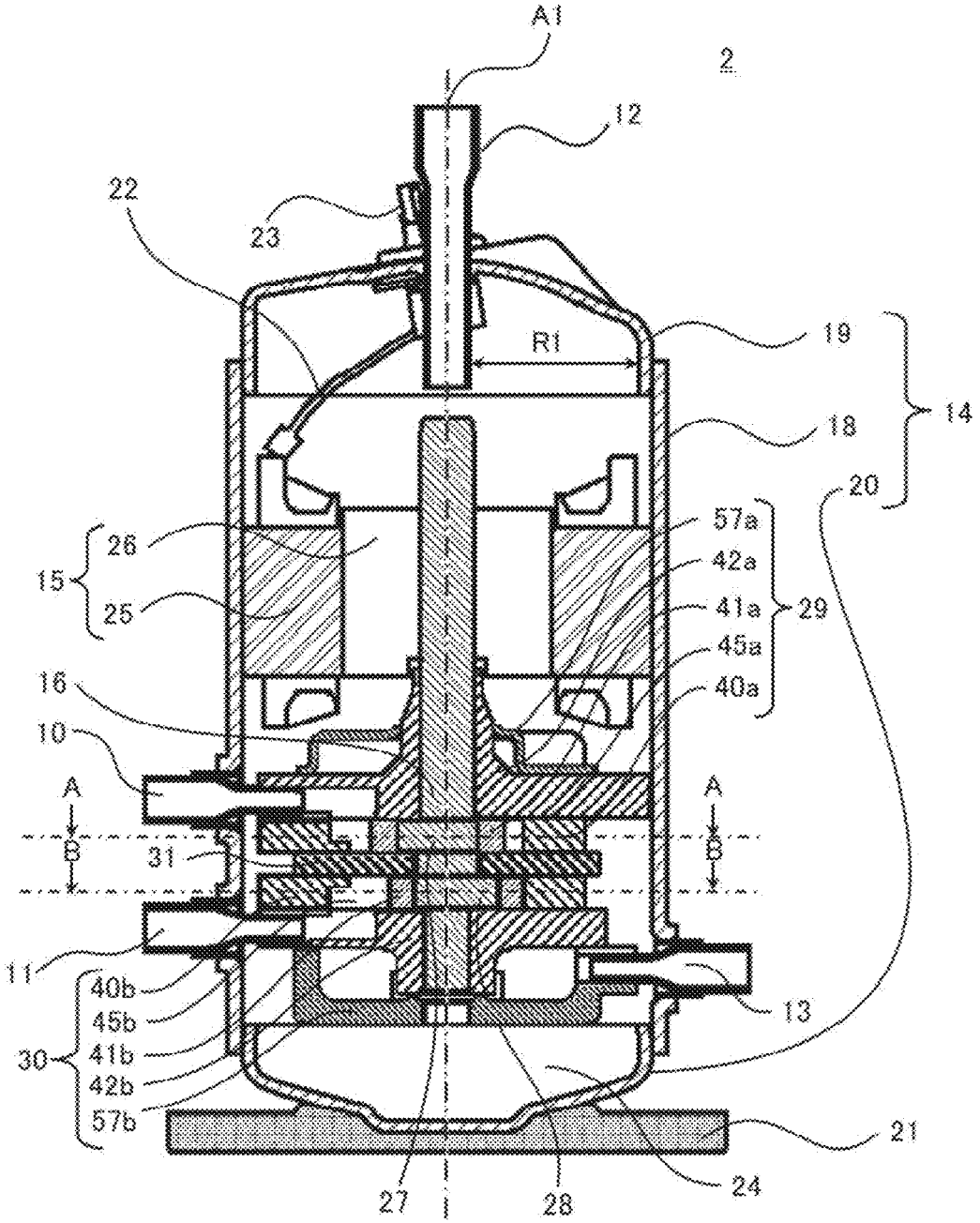
FIG. 2 is a vertical cross-sectional view of a compressor according to Embodiment 1.

In the descriptions below, the direction of the axis of a stator 25 and a rotor 26 denoted as A1 in FIG. 2 is referred to as "axial direction," and the direction of a radius about the axis illustrated by the arrow R1 in FIG. 2 is referred to as "radial direction." The compressor 2 includes a hermetically sealed container 14, an electric motor 15, a crankshaft 16, a low-stage compression mechanism unit 29, a high-stage compression mechanism unit 30, and an intermediate partition plate 31.

As illustrated in FIG. 2, the hermetically sealed container 14 includes a barrel portion 18 with a cylindrical shape, an upper lid portion 19 with a semispherical shape, and a lower lid portion 20 with a semispherical shape. The upper lid portion 19 and the lower lid portion 20 are welded to an upper part and a lower part of the barrel portion 18, respectively. The hermetically sealed container 14 is provided on a base 21 with the lower lid portion 20 and the base 21 fixed to each other. The hermetically sealed container 14 includes the refrigerant suction pipes 10 and 11 through which refrigerant is sucked, and the refrigerant discharge pipes 12 and 13 through which refrigerant is discharged. The hermetically sealed container 14 includes, on its upper portion, a terminal 23 connecting an external power supply and a lead wire 22. The hermetically sealed container 14 reserves refrigerating machine oil 24 in its bottom portion to lubricate sliding parts of the low-stage compression mechanism unit 29 and the high-stage compression mechanism unit 30. Examples of the refrigerating machine oil 24 include polyol ester (POE), polyvinyl ether (PVE), and alkyl benzene (AB).

The electric motor 15 includes the stator 25, and the rotor 26 positioned coaxially with the stator 25 with a constant gap from the stator 25. The electric motor 15 is installed in the barrel portion 18 and higher than the low-stage compression mechanism unit 29 and the high-stage compression mechanism unit 30 by use of spot welding, shrink fit, or other method. The electric motor 15 drives the low-stage compression mechanism unit 29 and the high-stage compression mechanism unit 30 through the crankshaft 16.

The crankshaft 16 has a low-stage eccentric portion 27 and a high-stage eccentric portion 28, each of which is eccentric in one direction. The crankshaft 16 is fitted into the rotor 26.

The low-stage compression mechanism unit 29, the high-stage compression mechanism unit 30, and the intermediate partition plate 31 are layered from the bottom in the order of the high-stage compression mechanism unit 30, the intermediate partition plate 31, and the low-stage compression mechanism unit 29.

Figure 3:
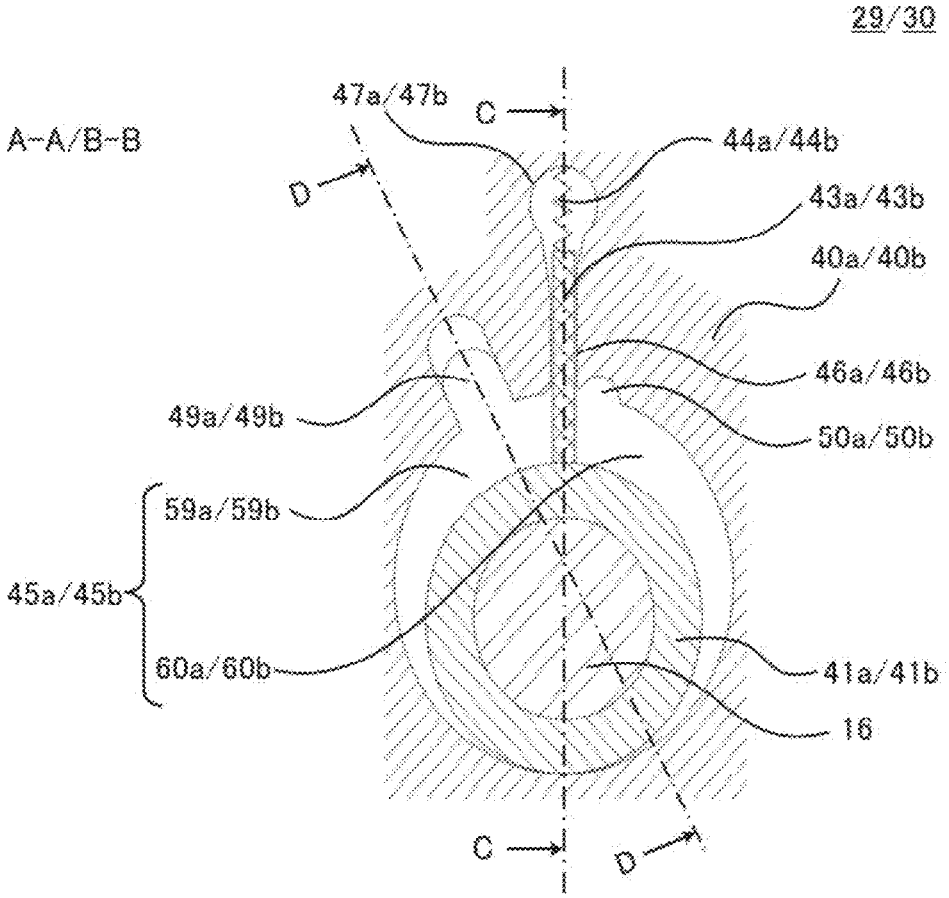
FIG. 3 is a schematic view in A-A cross-section and B-B cross-section of FIG. 2.
Figure 4:
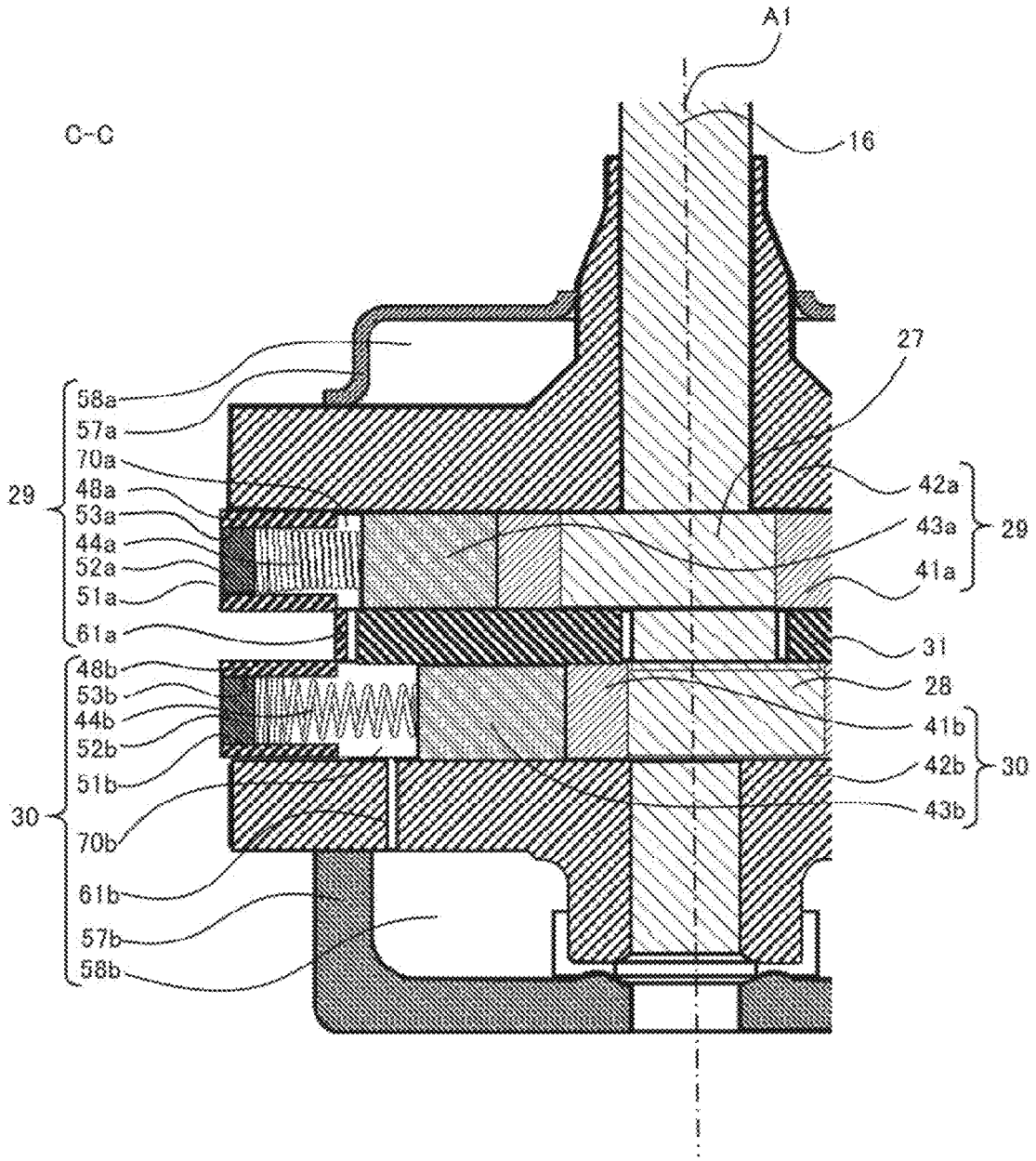
FIG. 4 is a C-C cross-sectional view of FIG. 3.
Figure 5:
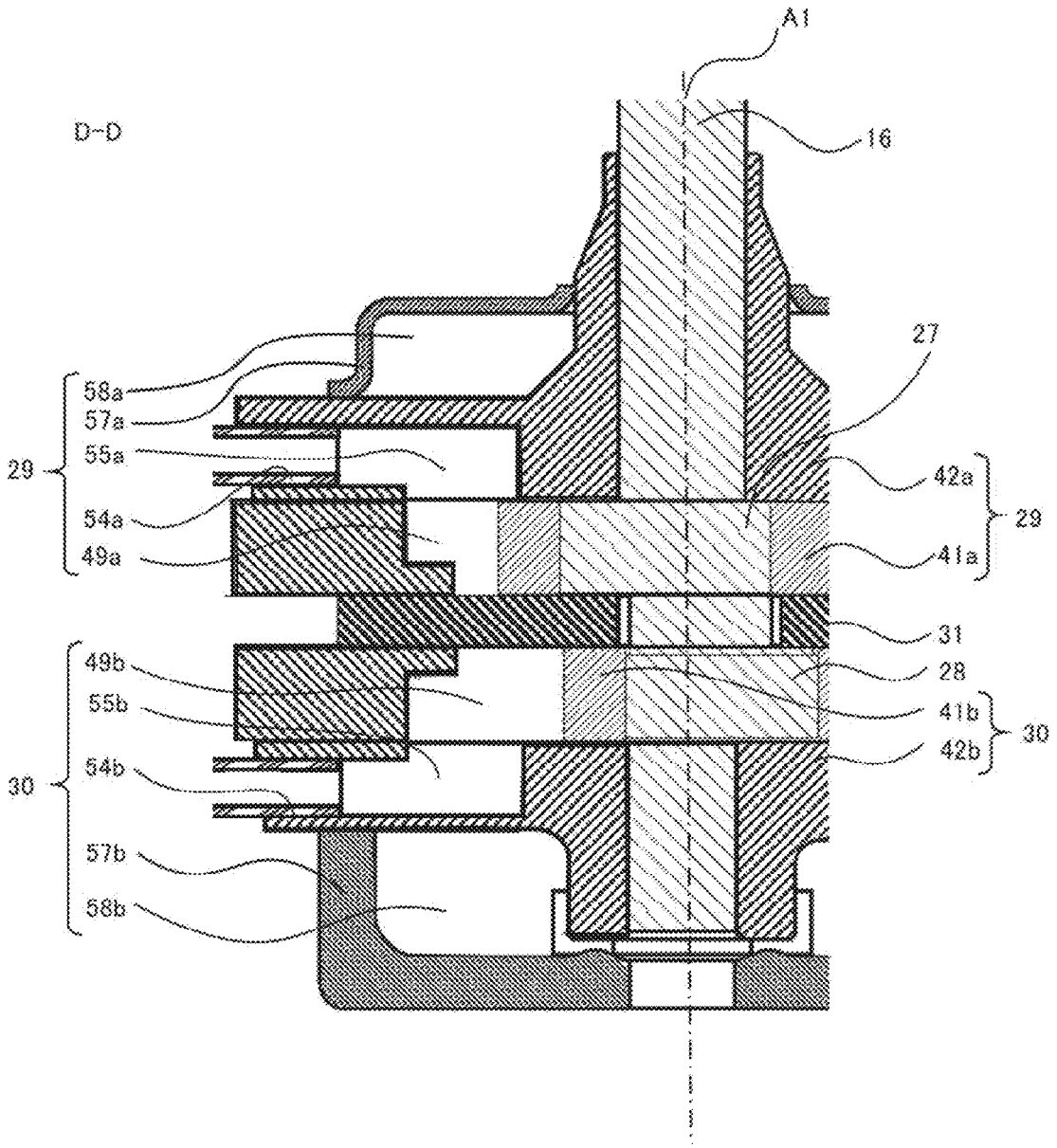
FIG. 5 is a D-D cross-sectional view of FIG. 3.

With reference to FIGS. 2 to 5, the low-stage compression mechanism unit 29 is described below. FIG. 3 illustrates a portion of the schematic view in A-A cross-section of FIG. 2. FIG. 4 is an enlarged view of the low-stage compression mechanism unit 29 and the high-stage compression mechanism unit 30 in FIG. 2 and a C-C cross-sectional view of FIG. 3. FIG. 5 is an enlarged view of the low-stage compression mechanism unit 29 and the high-stage compression mechanism unit 30 in FIG. 2 and a D-D cross-sectional view of FIG. 3.

The low-stage compression mechanism unit 29 illustrated in FIGS. 2 and 3 includes a low-stage cylinder block 40*a* with a cylindrical shape, a low-stage rolling piston 41*a* with a cylindrical shape, a low-stage bearing 42*a*, a low-stage vane 43*a* with a cuboid shape, and a low-stage spring 44*a*. The low-stage compression mechanism unit 29 compresses low-pressure refrigerant sucked from the refrigerant suction pipe 10 to intermediate pressure, and discharges the compressed refrigerant from the refrigerant discharge pipe 12. The low-stage cylinder block 40*a* and the low-stage bearing 42*a* are layered from the bottom in this order.

In the internal space of the low-stage cylinder block 40*a* illustrated in FIG. 3, a low-stage cylinder chamber 45*a*, a low-stage vane hole 46*a*, a low-stage hole 47*a*, a low-stage suction path 49*a*, and a low-stage discharge path 50*a* are formed. The low-stage cylinder chamber 45*a* is coaxial with the crankshaft 16. In the low-stage vane hole 46*a*, the low-stage vane 43*a* is located such that the low-stage vane 43*a* is slidable in the radial direction. The low-stage spring 44*a* is accommodated in the low-stage hole 47*a*. From the refrigerant suction pipe 10 through a low-stage suction connecting passage 55*a*, which will be described later, refrigerant is sucked into the low-stage suction path 49*a*. The refrigerant is discharged from the low-stage discharge path 50*a* to the refrigerant discharge pipe 12 via the internal space of the hermetically sealed container 14. FIG. 3 schematically illustrates the low-stage cylinder block 40*a*, while not illustrating a low-stage spring hole 48*a*, a low-stage female screw portion 51*a*, a low-stage plug 52*a*, and a low-stage male screw portion 53*a*, which will be described later.

The low-stage rolling piston 41*a* is located in the low-stage cylinder chamber 45*a*, and fitted onto the low-stage eccentric portion 27 of the crankshaft 16.

The low-stage vane hole 46*a* is located between the low-stage suction path 49*a* and the low-stage discharge path 50*a*. The low-stage vane hole 46*a* is formed in the radial direction, extending from the low-stage cylinder chamber 45*a* toward the low-stage hole 47*a*, while penetrating the low-stage cylinder block 40*a* in the axial direction.

The low-stage hole 47*a* is located between the low-stage suction path 49*a* and the low-stage discharge path 50*a*. The low-stage hole 47*a* is formed between the low-stage vane hole 46*a* and an outer circumferential surface of the low-stage cylinder block 40*a*, while penetrating the low-stage cylinder block 40*a* in the axial direction and communicating with the low-stage vane hole 46*a*.

The low-stage vane 43*a* illustrated in FIG. 3 is inserted into the low-stage vane hole 46*a* such that the low-stage vane 43*a* is slidable in the radial direction. The low-stage vane 43*a*, along with the low-stage rolling piston 41*a*, partition the low-stage cylinder chamber 45*a* into a low-stage suction chamber 59*a* and a low-stage compression chamber 60*a*. Note that a sliding surface of the low-stage vane 43*a* may be coated with a DLC coating or other type of coating such that the friction coefficient of the sliding surface is reduced.

The low-stage spring 44*a* is accommodated in the low-stage hole 47*a* and presses the low-stage vane 43*a* attached to a tip end of the low-stage spring 44*a* against an outer circumferential surface of the low-stage rolling piston 41*a*.

The low-stage spring hole 48*a*, the low-stage female screw portion 51*a*, the low-stage plug 52*a*, and the low-stage male screw portion 53*a* are described below with reference to FIGS. 3 and 4.

The low-stage cylinder block 40*a* illustrated in FIG. 3 is further provided with the low-stage spring hole 48*a* into which the low-stage spring 44*a* illustrated in FIG. 4 is inserted. The low-stage spring hole 48*a* is located between the low-stage suction path 49*a* and the low-stage discharge path 50*a*, which are illustrated in FIG. 3. The low-stage spring hole 48*a* is formed between the low-stage hole 47*a* and the outer circumferential surface of the low-stage cylinder block 40*a*, while communicating with the outer circumferential surface of the low-stage cylinder block 40*a* and with the low-stage hole 47*a* and the low-stage vane hole 46*a*. As illustrated in FIG. 4, the low-stage female screw portion 51*a* serving as a female screw groove is formed in the inner surface of the low-stage spring hole 48*a*. At a portion of the low-stage spring hole 48*a* that is in contact with the outer circumferential surface of the low-stage cylinder block 40*a*, the low-stage plug 52*a* is located closing this portion. In an outer surface of the low-stage plug 52*a*, the low-stage male screw portion 53*a* serving as a male screw groove is formed. The low-stage male screw portion 53*a* of the low-stage plug 52*a* is screwed into the low-stage female screw portion 51*a*, so that a low-stage back pressure chamber 70*a* is partitioned off from the internal space of the hermetically sealed container 14. The low-stage back pressure chamber 70*a* will be described later.

In the low-stage compression mechanism unit 29, the low-stage back pressure chamber 70*a* is formed by the outer circumferential surface of the low-stage cylinder block 40*a*, a lower surface of the low-stage bearing 42*a*, an upper surface of the intermediate partition plate 31, and the side surface of the low-stage vane 43*a* facing toward the outer circumferential surface.

Figure 8:
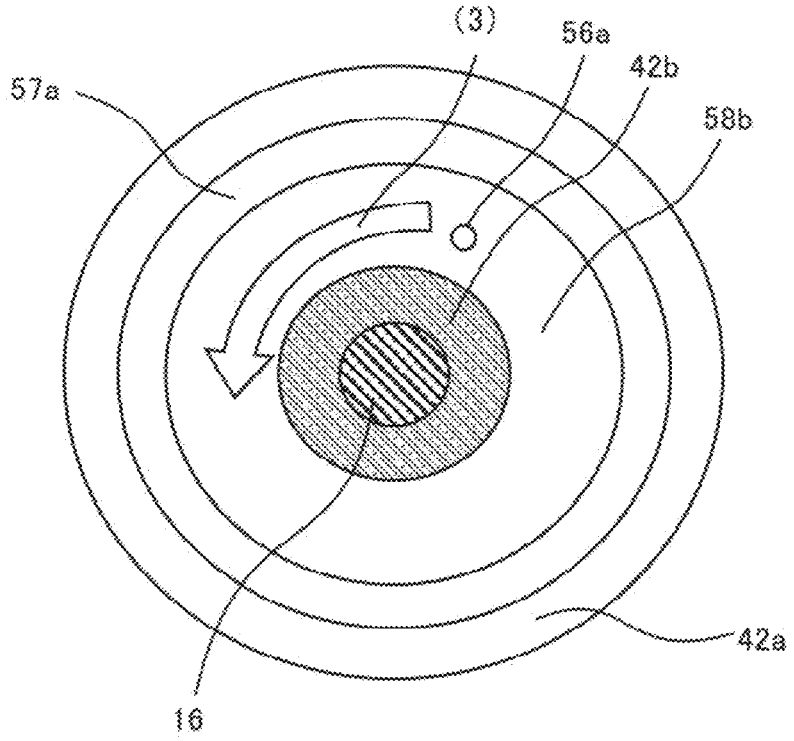
FIG. 8 is a schematic view in E-E cross-section of FIG. 7.

The low-stage bearing 42*a* illustrated in FIGS. 4 and 5 supports the crankshaft 16. In the low-stage bearing 42*a*, a low-stage suction hole 54*a*, a low-stage suction connecting passage 55*a*, and a first low-stage through hole 56*a* are formed. A tip end of the refrigerant suction pipe 10 is inserted into the low-stage suction hole 54*a*. The low-stage suction hole 54*a* and the low-stage suction path 49*a* communicate with each other through the low-stage suction connecting passage 55*a*. The low-stage discharge path 50*a* and the low-stage refrigerant supply passage 58*a* communicate with each other through the first low-stage through hole 56*a*, which will be described later. On a top portion of the low-stage bearing 42*a*, a low-stage discharge muffler 57*a* is located. The first low-stage through hole 56*a* is not illustrated in FIG. 4, which is the C-C cross-sectional view of FIG. 3, and is not illustrated in FIG. 5, which is the D-D cross-sectional view of FIG. 3, and instead, is illustrated in FIG. 8, which will be described later.

The low-stage refrigerant supply passage 58*a* is a space surrounded by the upper surface of the low-stage bearing 42*a* and the low-stage discharge muffler 57*a*, and serves as a path through which refrigerant compressed to intermediate pressure in the low-stage cylinder block 40*a* is discharged to the refrigerant discharge pipe 12.

With reference to FIGS. 2 to 5, the high-stage compression mechanism unit 30 is described below. FIG. 3 illustrates a portion of the schematic view in B-B cross-section of FIG. 2. FIG. 4 is an enlarged view of the low-stage compression mechanism unit 29 and the high-stage compression mechanism unit 30 in FIG. 2 and the C-C cross-sectional view of FIG. 3. FIG. 5 is an enlarged view of the low-stage compression mechanism unit 29 and the high-stage compression mechanism unit 30 in FIG. 2 and the D-D cross-sectional view of FIG. 3.

The high-stage compression mechanism unit 30 illustrated in FIGS. 2 and 3 includes a high-stage cylinder block 40*b* with a cylindrical shape, a high-stage rolling piston 41*b* with a cylindrical shape, a high-stage bearing 42*b*, a high-stage vane 43*b* with a cuboid shape, and a high-stage spring 44*b*. The high-stage compression mechanism unit 30 compresses intermediate-pressure refrigerant sucked from the refrigerant suction pipe 11 to high pressure, and discharges the compressed refrigerant from the refrigerant discharge pipe 13. The high-stage bearing 42*b* and the high-stage cylinder block 40*b* are layered from the bottom in this order.

In the internal space of the high-stage cylinder block 40*b* illustrated in FIG. 3, a high-stage cylinder chamber 45*b*, a high-stage vane hole 46*b*, a high-stage hole 47*b*, a high-stage suction path 49*b*, and a high-stage discharge path 50*b* are formed. The high-stage cylinder chamber 45*b* is coaxial with the crankshaft 16. In the high-stage vane hole 46*b*, the high-stage vane 43*b* is located such that the high-stage vane 43*b* is slidable in the radial direction. The high-stage spring 44*b* is accommodated in the high-stage hole 47*b*. From the refrigerant suction pipe 11 through a high-stage suction connecting passage 55*b*, which will be described later, refrigerant is sucked into the high-stage suction path 49*b*. The refrigerant is discharged through the high-stage discharge path 50*b* to the refrigerant discharge pipe 13 not via the internal space of the hermetically sealed container 14. FIG. 3 schematically illustrates the high-stage cylinder block 40*b*, while not illustrating a high-stage spring hole 48*b*, a high-stage female screw portion 51*b*, a high-stage plug 52*b*, and a high-stage male screw portion 53*b*, which will be described later.

The high-stage rolling piston 41*b* is located in the high-stage cylinder chamber 45*b*, and fitted onto the high-stage eccentric portion 28 of the crankshaft 16.

The high-stage vane hole 46*b* is located between the high-stage suction path 49*b* and the high-stage discharge path 50*b*. The high-stage vane hole 46*b* is formed in the radial direction, extending from the high-stage cylinder chamber 45*b* toward the high-stage hole 47*b*, while penetrating the high-stage cylinder block 40*b* in the axial direction.

The high-stage hole 47*b* is located between the high-stage suction path 49*b* and the high-stage discharge path 50*b*. The high-stage hole 47*b* is formed between the high-stage vane hole 46*b* and an outer circumferential surface of the high-stage cylinder block 40*b*, while penetrating the high-stage cylinder block 40*b* in the axial direction and communicating with the high-stage vane hole 46*b*.

The high-stage vane 43*b* illustrated in FIG. 3 is inserted into the high-stage vane hole 46*b* such that the high-stage vane 43*b* is slidable in the radial direction. The high-stage vane 43*b*, along with the high-stage rolling piston 41*b*, partition the high-stage cylinder chamber 45*b* into a high-stage suction chamber 59*b* and a high-stage compression chamber 60*b*. Note that a sliding surface of the high-stage vane 43*b* may be coated with a DLC coating or other type of coating such that the friction coefficient of the sliding surface is reduced.

The high-stage spring 44*b* is accommodated in the high-stage hole 47*b* and presses the high-stage vane 43*b* attached to a tip end of the high-stage spring 44*b* against an outer circumferential surface of the high-stage rolling piston 41*b*.

The high-stage spring hole 48*b*, the high-stage female screw portion 51*b*, the high-stage plug 52*b*, and the high-stage male screw portion 53*b* are described below with reference to FIGS. 3 and 4.

The high-stage cylinder block 40*b* illustrated in FIG. 3 is further provided with the high-stage spring hole 48*b* into which the high-stage spring 44*b* illustrated in FIG. 4 is inserted. The high-stage spring hole 48*b* is located between the high-stage suction path 49*b* and the high-stage discharge path 50*b* illustrated in FIG. 3. The high-stage spring hole 48*b* is formed between the high-stage hole 47*b* and the outer circumferential surface of the high-stage cylinder block 40*b*, while communicating with the outer circumferential surface of the high-stage cylinder block 40*b* and with the high-stage hole 47*b* and the high-stage vane hole 46*b*. As illustrated in FIG. 4, the high-stage female screw portion 51*b* serving as a female screw groove is formed in the inner surface of the high-stage spring hole 48*b*. At a portion of the high-stage spring hole 48*b* that is in contact with the outer circumferential surface of the high-stage cylinder block 40*b*, the high-stage plug 52*b* is located closing this portion. In an outer surface of the high-stage plug 52*b*, the high-stage male screw portion 53*b* serving as a male screw groove is formed. The high-stage male screw portion 53*b* of the high-stage plug 52*b* is screwed into the high-stage female screw portion 51*b*, so that a high-stage back pressure chamber 70*b* is partitioned off from the internal space of the hermetically sealed container 14. The high-stage back pressure chamber 70*b* will be described later.

In the high-stage compression mechanism unit 30, the high-stage back pressure chamber 70*b* is formed by the outer circumferential surface of the high-stage cylinder block 40*b*, an upper surface of the high-stage bearing 42*b*, a lower surface of the intermediate partition plate 31, and the side surface of the high-stage vane 43*b* facing toward the outer circumferential surface.

Figure 9:
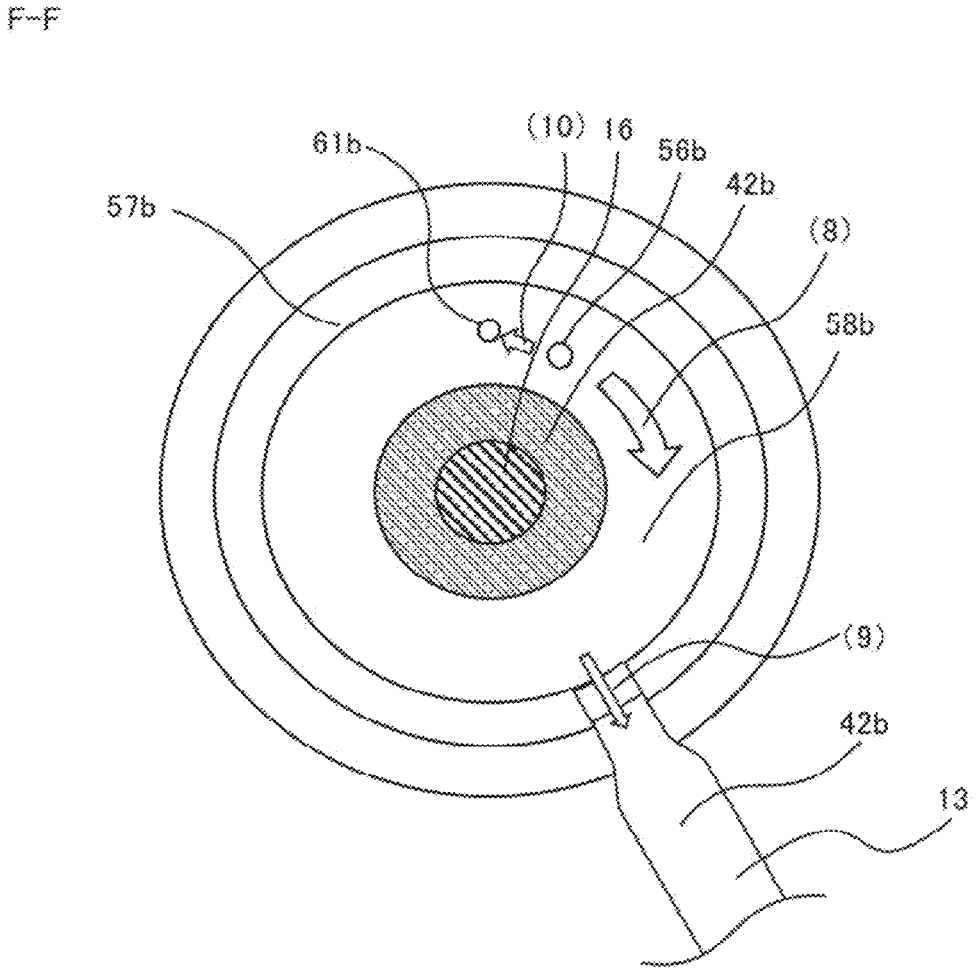
FIG. 9 is a schematic view in F-F cross-section of FIG. 7.

The high-stage bearing 42*b* illustrated in FIGS. 4 and 5 supports the crankshaft 16. In the high-stage bearing 42*b*, a high-stage suction hole 54*b*, a high-stage suction connecting passage 55*b*, a first high-stage through hole 56*b*, and a second high-stage through hole 61*b* are formed. A tip end of the refrigerant suction pipe 11 is inserted into the high-stage suction hole 54*b*. The high-stage suction hole 54*b* and the high-stage suction path 49*b* communicate with each other through the high-stage suction connecting passage 55*b*. The high-stage discharge path 50*b* and the high-stage refrigerant supply passage 58*b* communicate with each other through the first high-stage through hole 56*b*, which will be described later. The high-stage back pressure chamber 70*b* and the high-stage refrigerant supply passage 58*b* communicate with each other through the second high-stage through hole 61*b*. On a lower portion of the high-stage bearing 42*b*, a high-stage discharge muffler 57*b* is located. The first high-stage through hole 56*b* is not illustrated in FIG. 4, which is the C-C cross-sectional view of FIG. 3, and is not illustrated in FIG. 5, which is the D-D cross-sectional view of FIG. 3, and instead, is illustrated in FIG. 9, which will be described later.

The high-stage refrigerant supply passage 58*b* is a space surrounded by the lower surface of the high-stage bearing 42*b* and the high-stage discharge muffler 57*b*, and serves as a path through which refrigerant compressed to high pressure in the high-stage cylinder block 40*b* is discharged to the refrigerant discharge pipe 13.

The intermediate partition plate 31 is installed between the low-stage cylinder block 40*a* and the high-stage cylinder block 40*b* to partition the low-stage cylinder chamber 45*a* and the high-stage cylinder chamber 45*b* off from each other as separate spaces. In the intermediate partition plate 31, a second low-stage through hole 61*a* is formed through which the low-stage back pressure chamber 70*a* and the high-stage refrigerant supply passage 58*b* communicate with each other.

Operation of the compressor 2 is described below with reference to FIGS. 6 to 9. FIG. 7 is an enlarged view of the low-stage compression mechanism unit 29 and the high-stage compression mechanism unit 30 in FIG. 6. The left half of the enlarged view from the axis A1 in FIG. 7 is the C-C cross-sectional view of FIG. 3. The right half of the enlarged view from the axis A1 in FIG. 7 is the D-D cross-sectional view of FIG. 3. FIG. 8 is a schematic view in E-E cross-section of FIG. 7. FIG. 9 is a schematic view in F-F cross-section of FIG. 7. The arrows (1) to (11) illustrated in FIGS. 6 to 9 each show the direction of refrigerant flow.

First, when power is supplied to the electric motor 15 from the terminal 23 through the lead wire 22, the crankshaft 16 fitted into the rotor 26 rotates, and the low-stage rolling piston 41*a* eccentrically rotates in the low-stage cylinder chamber 45*a*. This causes variations in volumes of two spaces, which are the low-stage suction chamber 59*a* and the low-stage compression chamber 60*a* divided by the low-stage rolling piston 41*a* and the low-stage vane 43*a*. As the volume of the low-stage suction chamber 59*a* gradually increases, the low-pressure refrigerant is sucked from the low-stage suction path 49*a* via the low-pressure refrigerant pipe 7, the refrigerant suction pipe 10, and the low-stage suction connecting passage 55*a* as shown by the arrows (1) and (2) in FIG. 6. As the volume of the low-stage compression chamber 60*a* gradually decreases, the sucked low-pressure refrigerant is compressed, and as shown by the arrows (3) and (4) in FIGS. 6 and 8, the intermediate-pressure refrigerant is discharged to the inside of the hermetically sealed container 14 via the low-stage discharge path 50*a*, the first low-stage through hole 56*a*, the low-stage refrigerant supply passage 58*a*, and the low-stage discharge muffler 57*a*.

The first low-stage through hole 56*a* is described below in detail with reference to FIGS. 6 and 8.

The first low-stage through hole 56*a* illustrated in FIG. 8 is provided in the low-stage bearing 42*a* such that the low-stage discharge path 50*a* and the low-stage refrigerant supply passage 58*a* communicate with each other. The first low-stage through hole 56*a* is provided through which refrigerant flows from the low-stage discharge path 50*a* to the low-stage refrigerant supply passage 58*a* as shown by the arrow (3) in FIG. 6. Then, refrigerant is supplied to the low-stage refrigerant supply passage 58*a* and discharged from the low-stage discharge muffler 57*a* to the internal space of the hermetically sealed container 14 as shown by the arrow (4) in FIG. 6.

Figure 6:
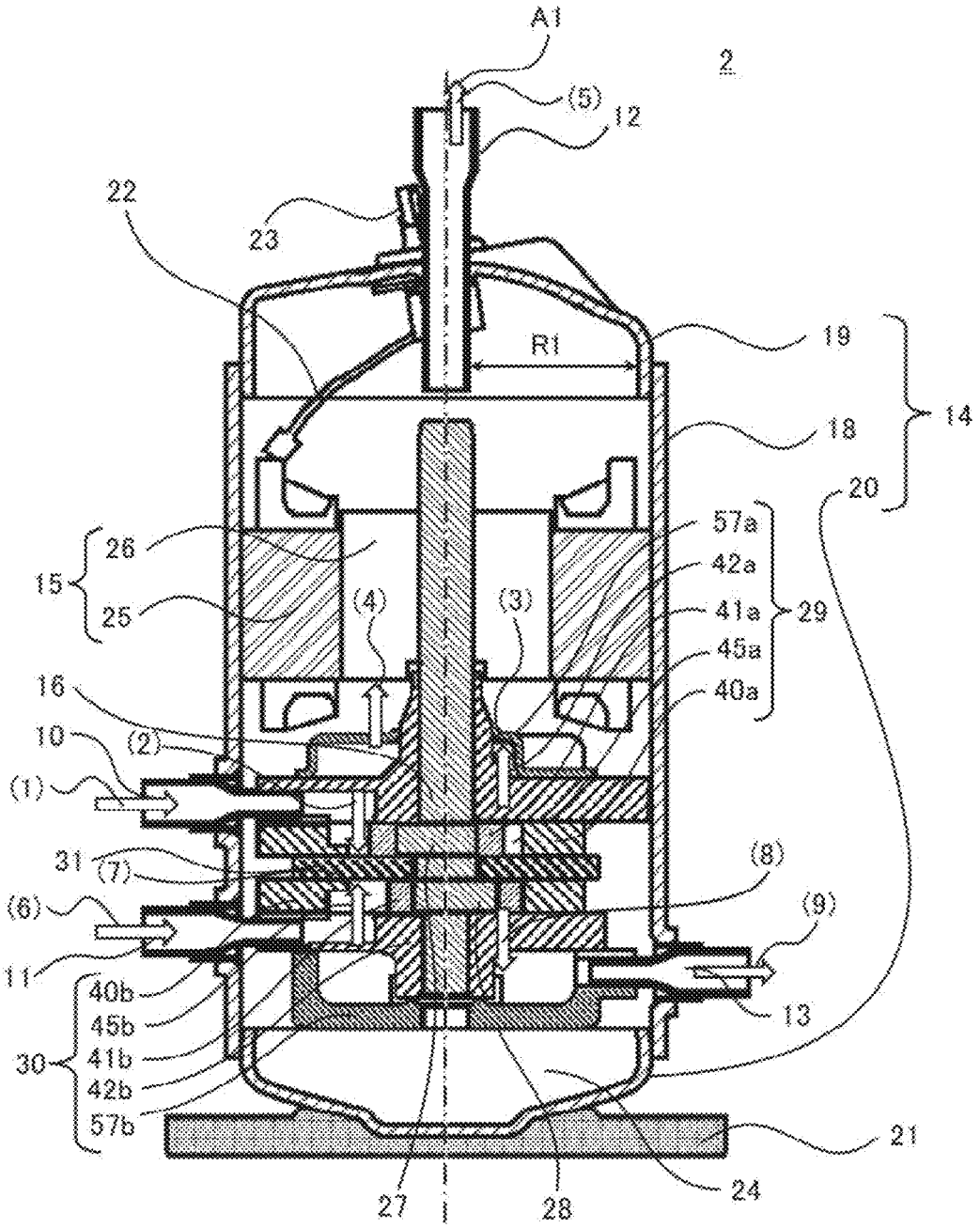
FIG. 6 illustrates a flow of refrigerant during operation of a compressor in FIG. 1.
Figure 7:
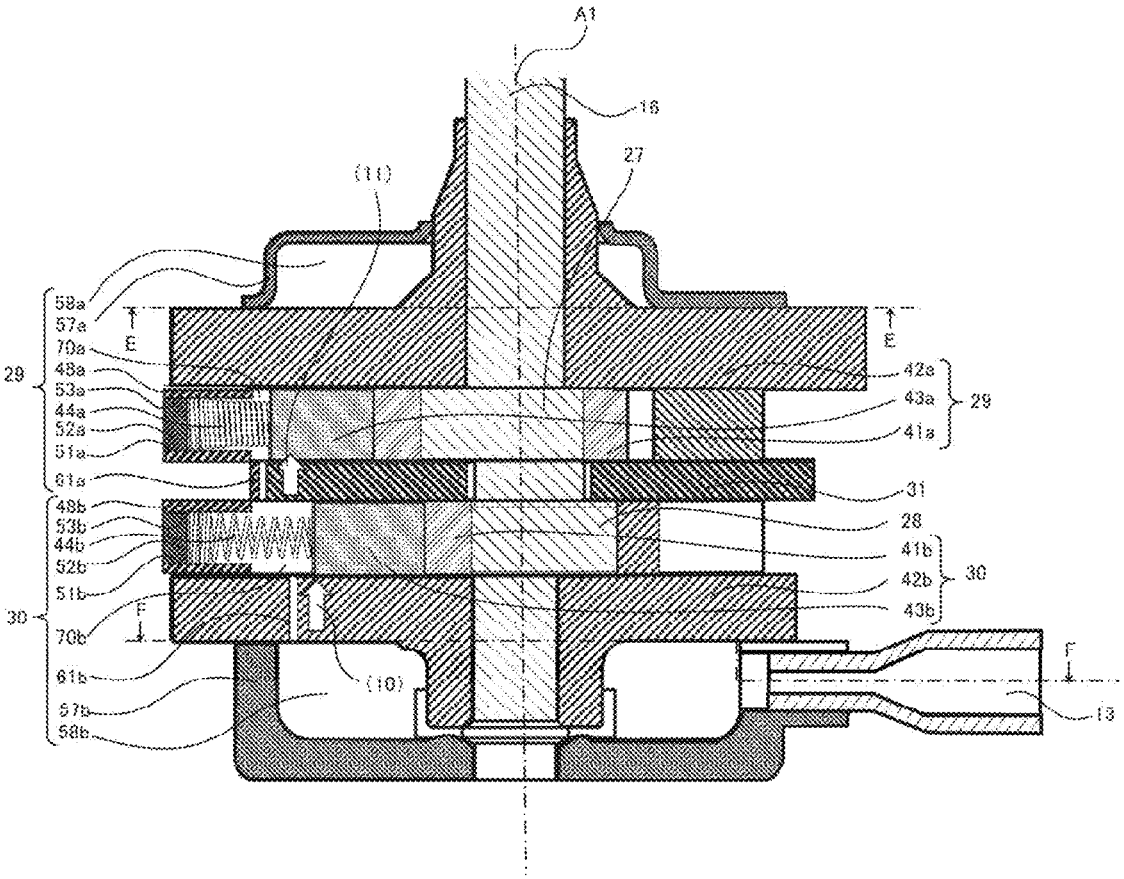
FIG. 7 illustrates a flow of refrigerant during operation of the compressor according to the present Embodiment 1.

The arrow (3) in FIG. 8 shows a state of a flow of refrigerant in the low-stage refrigerant supply passage 58*a* after the flow of refrigerant shown by the arrow (3) in FIG. 6 has passed through the first low-stage through hole 56*a*.

As shown by the arrows (5) and (6) in FIG. 6, intermediate-pressure refrigerant having been discharged to the inside of the hermetically sealed container 14 is discharged from the refrigerant discharge pipe 12 and sucked into the refrigerant suction pipe 11 through the intermediate-pressure refrigerant pipe 8.

In the same manner as the low-stage compression mechanism unit 29, the high-stage rolling piston 41*b* eccentrically rotates in the high-stage cylinder chamber 45*b*. This causes variations in volumes of two spaces, which are the high-stage suction chamber 59*b* and the high-stage compression chamber 60*b* divided by the high-stage rolling piston 41*b* and the high-stage vane 43*b*. As the volume of the high-stage suction chamber 59*b* gradually increases, the intermediate-pressure refrigerant is sucked from the high-stage suction path 49*b* via the intermediate-pressure refrigerant pipe 8, the refrigerant suction pipe 11, and the high-stage suction connecting passage 55*b* as shown by the arrows (6) and (7) in FIG. 6. As the volume of the high-stage compression chamber 60*b* gradually decreases, the sucked intermediate-pressure refrigerant is compressed, and as shown by the arrows (8) and (9) in FIGS. 6 and 9, the high-pressure refrigerant is discharged from the refrigerant discharge pipe 13 via the high-stage discharge path 50*b*, the first high-stage through hole 56*b*, the high-stage refrigerant supply passage 58*b*, and the high-stage discharge muffler 57*b*. At the same time, the high-pressure refrigerant discharged to the high-stage discharge muffler 57*b* is supplied to the high-stage back pressure chamber 70*b* via the second high-stage through hole 61*b* as shown by the arrow (10) in FIGS. 7 and 9, and is thereafter supplied to the low-stage back pressure chamber 70*a* via the second low-stage through hole 61*a* as shown by the arrow (11) in FIG. 7.

The first high-stage through hole 56*b* and the second high-stage through hole 61*b* are described below in detail with reference to FIGS. 6, 7, and 9.

The first high-stage through hole 56*b* illustrated in FIG. 9 is provided in the high-stage bearing 42*b* such that the high-stage discharge path 50*b* and the high-stage refrigerant supply passage 58*b* communicate with each other. The first high-stage through hole 56*b* is provided through which refrigerant flows from the high-stage discharge path 50*b* to the high-stage refrigerant supply passage 58*b* as shown by the arrow (8) in FIG. 6. Then, refrigerant is supplied to the high-stage refrigerant supply passage 58*b*, and high-pressure refrigerant is discharged from the high-stage discharge muffler 57*b* through the refrigerant discharge pipe 13 as shown by the arrow (9) in FIG. 6.

The arrow (8) in FIG. 9 shows a state of a flow of refrigerant in the high-stage refrigerant supply passage 58*b* after the flow of refrigerant shown by the arrow (8) in FIG. 6 has passed through the first high-stage through hole 56*b*. The arrow (10) in FIG. 9 shows a state of a flow of refrigerant in the high-stage refrigerant supply passage 58*b* before the flow of refrigerant shown by the arrow (10) in FIG. 7 passes through the second high-stage through hole 61*b*.

In the compressor 2 of the present embodiment, the high-pressure refrigerant discharged to the high-stage discharge muffler 57*b* is supplied to the high-stage back pressure chamber 70*b* via the second high-stage through hole 61*b*, and is thereafter supplied to the low-stage back pressure chamber 70*a* via the second low-stage through hole 61*a*. In the low-stage compression mechanism unit 29, the low-stage back pressure chamber 70*a* is filled with high-pressure refrigerant, while the low-stage suction chamber 59*a* and the low-stage compression chamber 60*a* are filled with low-pressure refrigerant and intermediate-pressure refrigerant, respectively. With this configuration, the refrigerant pressure level relationship between the low-stage back pressure chamber 70*a* and the low-stage cylinder chamber 45*a* is expressed as "low-stage back pressure chamber 70*a*>low-stage cylinder chamber 45*a*." Thus, this prevents a force from being applied to the low-stage vane 43*a* in a direction from the low-stage cylinder chamber 45*a* toward the low-stage back pressure chamber 70*a*, and prevents the low-stage vane 43*a* from separating from the low-stage rolling piston 41*a*. As a result, it is possible to prevent poor contact between the low-stage vane 43*a* and the low-stage rolling piston 41*a*.

Furthermore, the poor contact between the low-stage vane 43*a* and the low-stage rolling piston 41*a* is thus prevented, so that the low-stage vane 43*a* has an improved capability to follow the motion of the low-stage rolling piston 41*a*. As a result, it is possible to prevent improper compression of refrigerant caused by the low-stage suction chamber 59*a* and the low-stage compression chamber 60*a* that are not completely partitioned off from each other.

It is also possible to reduce the level of noise produced by an impact between the low-stage vane 43*a* and the low-stage rolling piston 41*a* caused by repeated separation and contact of the low-stage vane 43*a* from and with the low-stage rolling piston 41*a* in a case where the low-stage vane 43*a* has a low capability to follow the motion of the low-stage rolling piston 41*a*.

In the high-stage compression mechanism unit 30, the high-stage back pressure chamber 70*b* is filled with high-pressure refrigerant, while the high-stage suction chamber 59*b* and the high-stage compression chamber 60*b* are filled with intermediate-pressure refrigerant and high-pressure refrigerant, respectively. With this configuration, the refrigerant pressure level relationship between the high-stage back pressure chamber 70*b* and the high-stage cylinder chamber 45*b* is expressed as "high-stage back pressure chamber 70*b*≥high-stage cylinder chamber 45*b*." Thus, this prevents a force from being applied to the high-stage vane 43*b* in a direction from the high-stage cylinder chamber 45*b* toward the high-stage back pressure chamber 70*b*, and prevents the high-stage vane 43*b* from separating from the high-stage rolling piston 41*b*. As a result, it is possible to prevent poor contact between the high-stage vane 43*b* and the high-stage rolling piston 41*b*.

Furthermore, poor contact between the high-stage vane 43*b* and the high-stage rolling piston 41*b* is prevented, so that the high-stage vane 43*b* has an improved capability to follow the motion of the high-stage rolling piston 41*b*. As a result, it is possible to prevent improper compression of refrigerant caused by the high-stage suction chamber 59*b* and the high-stage compression chamber 60*b* that are not completely partitioned off from each other.

It is also possible to reduce the level of noise produced by an impact between the high-stage vane 43*b* and the high-stage rolling piston 41*b* caused by repeated separation and contact of the high-stage vane 43*b* from and with the high-stage rolling piston 41*b* in a case where the high-stage vane 43*b* has a low capability to follow the motion of the high-stage rolling piston 41*b*.

Note that in the present embodiment, an example has been described in which the low-stage compression mechanism unit 29 is positioned at an upper stage, while the high-stage compression mechanism unit 30 is positioned at a lower stage; however, the low-stage compression mechanism unit 29 may be positioned at a lower stage, while the high-stage compression mechanism unit 30 may be positioned at an upper stage.

Note that in the present embodiment, an example has been described in which the low-stage male screw portion 53*a* of the low-stage plug 52*a* is screwed into the low-stage female screw portion 51*a* and the low-stage back pressure chamber 70*a* and the interior of the hermetically sealed container 14 are thus partitioned off from each other, and the high-stage male screw portion 53*b* of the high-stage plug 52*b* is screwed into the high-stage female screw portion 51*b* and the high-stage back pressure chamber 70*b* and the interior of the hermetically sealed container 14 are thus partitioned off from each other; however, the low-stage plug 52*a* and the high-stage plug 52*b* may be joined respectively to the low-stage spring hole 48*a* and the high-stage spring hole 48*b* by welding or other method.

Note that in the embodiment explained above in the present specification, materials, quality of the materials, dimensions, shapes, relative arrangement relationship, conditions for implementation, and other features of the constituent elements are described sometimes; however, they are merely examples in all aspects and do not limit the constituent elements to the described examples. Therefore, innumerable modifications that are not exemplified are conceivable within the scope of the embodiment. For example, cases are included where any of the constituent elements is modified, added, or omitted, and cases are also included where at least one constituent element in at least one embodiment is extracted and combined with a constituent element in another embodiment.

REFERENCE SIGNS LIST

1: refrigeration cycle apparatus, 2: compressor, 3: high-pressure side heat exchanger, 4: pressure-reducing device, 5: low-pressure side heat exchanger, 14: hermetically sealed container, 15: electric motor, 16: crankshaft, 29: low-stage compression mechanism unit, 30: high-stage compression mechanism unit, 40*a*: low-stage cylinder block, 40*b*: high-stage cylinder block, 41*a*: low-stage rolling piston, 41*b*: high-stage rolling piston, 42*a*: low-stage bearing, 42*b*: high-stage bearing, 43*a*: low-stage vane, 43*b*: high-stage vane, 48*a*: low-stage spring hole, 48*b*: high-stage spring hole, 51*a*: low-stage female screw portion, 51*b*: high-stage female screw portion, 52*a*: low-stage plug, 52*b*: high-stage plug, 53*a*: low-stage male screw portion, 53*b*: high-stage male screw portion, 57*a*: low-stage discharge muffler, 57*b*: high-stage discharge muffler, 58*a*: low-stage refrigerant supply passage, 58*b*: high-stage refrigerant supply passage, 59*a*: low-stage suction chamber, 59*b*: high-stage suction chamber, 60*a*: low-stage compression chamber, 60*b*: high-stage compression chamber, 61*a*: second low-stage through hole, 61*b*: second high-stage through hole, 70*a*: low-stage back pressure chamber, 70*b*: high-stage back pressure chamber

The invention claimed is:

1. A compressor comprising: a hermetically sealed container; an electric motor; a low-stage compression mechanism unit driven by a crankshaft fitted into the electric motor and configured to compress low-pressure refrigerant to intermediate pressure; a high-stage compression mechanism unit driven by the crankshaft and configured to compress intermediate-pressure refrigerant discharged by the low-stage compression mechanism unit to high pressure; and an intermediate partition plate provided between the low-stage compression mechanism unit and the high-stage compression mechanism unit, the electric motor, the low-stage compression mechanism unit, the high-stage compression mechanism unit, and the intermediate partition plate being accommodated in an internal space of the hermetically sealed container, the high-stage compression mechanism unit including a high-stage cylinder block with a cylindrical shape, a high-stage rolling piston located in an internal space of the high-stage cylinder block, a high-stage vane located in the high-stage cylinder block such that the high-stage vane is slidable in a radial direction of the high-stage cylinder block, the high-stage vane being configured to partition, along with the high-stage rolling piston, the internal space of the high-stage cylinder block into a high-stage suction chamber into which refrigerant is sucked and a high-stage compression chamber in which refrigerant is compressed, and a high-stage refrigerant supply passage serving as a path through which refrigerant compressed in the high-stage compression chamber is discharged to a space external to the hermetically sealed container, the high-stage refrigerant supply passage being a space surrounded by a high-stage bearing and a high-stage discharge muffler, the high-stage bearing supporting the crankshaft and being adjacent to the high-stage cylinder block in an axial direction of the high-stage cylinder block, the high-stage discharge muffler being adjacent to the high-stage bearing in an axial direction of the high-stage cylinder block, the high-stage cylinder block including a high-stage back pressure chamber, the high-stage back pressure chamber being a space surrounded by an outer circumferential surface of the high-stage cylinder block, the high-stage bearing, the intermediate partition plate, and the high-stage vane, the high-stage back pressure chamber being a space separate from the internal space of the hermetically sealed container, and communicating with the high-stage refrigerant supply passage, in the high-stage bearing, a high-stage through hole being formed through which the high-stage back pressure chamber and the high-stage refrigerant supply passage communicate with each other, and in the high-stage bearing, a high-stage suction hole being formed and a tip end of a refrigerant suction pipe being inserted into the high-stage suction hole, wherein the low-stage compression mechanism unit, the high-stage compression mechanism unit, and the intermediate partition plate are layered from the bottom of the compressor in the order of the high-stage compression mechanism unit, the intermediate partition plate, and the low-stage compression mechanism unit.

2. The compressor of claim 1, wherein in the high-stage bearing, a high-stage through hole is formed through which the high-stage back pressure chamber and the high-stage refrigerant supply passage communicate with each other.

3. The compressor of claim 1, comprising:

a high-stage spring hole formed in the high-stage cylinder block such that an outer circumferential surface of the high-stage cylinder block and the high-stage back pressure chamber communicate with each other; and a high-stage plug provided at a portion of the high-stage spring hole, the portion being in contact with an outer circumferential surface of the high-stage cylinder block, such that the high-stage plug closes the high-stage spring hole.

4. The compressor of claim 3, wherein a high-stage female screw portion is formed in the high-stage spring hole, a high-stage male screw portion is formed in the high-stage plug, and the high-stage plug is screwed into the high-stage spring hole.

5. A refrigeration cycle apparatus comprising:

the compressor of claim 1;

a condenser liquefying refrigerant discharged from the compressor;

a pressure-reducing device configured to reduce a pressure of refrigerant delivered from the condenser; and an evaporator gasifying refrigerant delivered from the pressure-reducing device.

6. A compressor comprising: a hermetically sealed container; an electric motor; a low-stage compression mechanism unit driven by a crankshaft fitted into the electric motor and configured to compress low-pressure refrigerant to intermediate pressure; a high-stage compression mechanism unit driven by the crankshaft and configured to compress intermediate-pressure refrigerant discharged by the low-stage compression mechanism unit to high pressure; and an intermediate partition plate provided between the low-stage compression mechanism unit and the high-stage compression mechanism unit, the electric motor, the low-stage compression mechanism unit, the high-stage compression mechanism unit, and the intermediate partition plate being accommodated in an internal space of the hermetically sealed container, wherein the high-stage compression mechanism unit includes a high-stage cylinder block with a cylindrical shape, a high-stage rolling piston located in an internal space of the high-stage cylinder block, a high-stage vane located in the high-stage cylinder block such that the high-stage vane is slidable in a radial direction of the high-stage cylinder block, the high-stage vane being configured to partition, along with the high-stage rolling piston, the internal space of the high-stage cylinder block into a high-stage suction chamber into which refrigerant is sucked and a high-stage compression chamber in which refrigerant is compressed, and a high-stage refrigerant supply passage serving as a path through which refrigerant compressed in the high-stage compression chamber is discharged to a space external to the hermetically sealed container, the high-stage refrigerant supply passage being a space surrounded by a high-stage bearing and a high-stage discharge muffler, the high-stage bearing supporting the crankshaft and being adjacent to the high-stage cylinder block in an axial direction of the high-stage cylinder block, the high-stage discharge muffler being adjacent to the high-stage bearing in an axial direction of the high-stage cylinder block, the high-stage cylinder block includes a high-stage back pressure chamber, the high-stage back pressure chamber being a space surrounded by an outer circumferential surface of the high-stage cylinder block, the high-stage bearing, the intermediate partition plate, and the high-stage vane, the high-stage back pressure chamber is a space separate from the internal space of the hermetically sealed container, and communicates with the high-stage refrigerant supply passage, in the high-stage bearing, a high-stage suction hole is formed and a tip end of a refrigerant suction pipe is inserted into the high-stage suction hole, the low-stage compression mechanism unit includes a low-stage cylinder block with a cylindrical shape, a low-stage rolling piston located in an internal space of the low-stage cylinder block, and a low-stage vane located in the low-stage cylinder block such that the low-stage vane is slidable in a radial direction of the low-stage cylinder block, the low-stage vane being configured to partition, along with the low-stage rolling piston, the internal space of the low-stage cylinder block into a low-stage suction chamber into which refrigerant is sucked by increasing a volume of the low-stage suction chamber and a low-stage compression chamber in which refrigerant is compressed by decreasing a volume of the low-stage compression chamber, the low-stage cylinder block includes a low-stage back pressure chamber, the low-stage back pressure chamber being a space surrounded by an outer circumferential surface of the low-stage cylinder block, a low-stage bearing, the intermediate partition plate, and the low-stage vane, the low-stage bearing supporting the crankshaft and being adjacent to the low-stage cylinder block in an axial direction of the low-stage cylinder block, and the low-stage back pressure chamber is a space separate from the internal space of the hermetically sealed container, and communicates with the high-stage refrigerant supply passage-not via the internal space of the hermetically sealed container, wherein the low-stage compression mechanism unit, the high-stage compression mechanism unit, and the intermediate partition plate are layered from the bottom of the compressor in the order of the high-stage compression mechanism unit, the intermediate partition plate, and the low-stage compression mechanism unit.

7. The compressor of claim 6, wherein in the intermediate partition plate, a low-stage through hole is formed through which the low-stage back pressure chamber and the high-stage refrigerant supply passage communicate with each other.

8. The compressor of claim 6, comprising:

a low-stage spring hole formed in the low-stage cylinder block such that an outer circumferential surface of the low-stage cylinder block and the low-stage back pressure chamber communicate with each other; and a low-stage plug provided at a portion of the low-stage spring hole, the portion being in contact with an outer circumferential surface of the low-stage cylinder block, such that the low-stage plug closes the low-stage spring hole.

9. The compressor of claim 8, wherein a low-stage female screw portion is formed in the low-stage spring hole, a low-stage male screw portion is formed in the low-stage plug, and the low-stage plug is screwed into the low-stage spring hole.

10. The compressor of claim 6, wherein a refrigerant discharge pipe discharges refrigerant from the low-stage compression mechanism unit, and the refrigerant suction pipe receives refrigerant from the refrigerant discharge pipe.

11. The compressor of claim 6, wherein the bottom of the compressor is a side of the compressor adjacent to a base to which the compressor is fixed.

* * * * *